United States Patent [19]

Parks

[11] Patent Number: 4,632,275

[45] Date of Patent: Dec. 30, 1986

[54] PALATABILITY STABILIZER

[76] Inventor: Charles K. Parks, P.O. Box 998, Abilene, Tex. 79604

[21] Appl. No.: 653,874

[22] Filed: Sep. 21, 1984

[51] Int. Cl.[4] ..... B67D 1/00

[52] U.S. Cl. ..... 222/25; 222/52; 222/63; 222/66; 222/129.1; 261/DIG. 7

[58] Field of Search ..... 222/52, 61, 129.1, 129.4, 222/25, 63, 66; 261/DIG. 7

[56] References Cited

U.S. PATENT DOCUMENTS

| | | | |
|---|---|---|---|
| 2,880,910 | 4/1959 | Hanson et al. . | |
| 3,112,844 | 12/1963 | Keller et al. . | |
| 3,221,936 | 12/1965 | Spinuzza | 222/61 X |
| 3,366,276 | 1/1968 | Fridley . | |
| 3,537,616 | 11/1970 | Diebel . | |
| 3,583,601 | 6/1971 | Ayers | 222/129.1 X |
| 3,648,694 | 3/1972 | Mogos et al. . | |
| 3,666,143 | 5/1972 | Weston . | |
| 3,756,464 | 9/1973 | Fuqua . | |
| 3,804,299 | 4/1974 | Kain . | |
| 3,939,667 | 2/1976 | Halverson | 222/129.1 X |
| 3,940,019 | 2/1976 | Kross et al. . | |
| 3,981,414 | 9/1976 | Gust et al. . | |

*Primary Examiner*—Joseph J. Rolla

*Assistant Examiner*—Frederick R. Handren

*Attorney, Agent, or Firm*—Sigalos & Levine

[57] ABSTRACT

The present invention relates to a palatability stabilizer for maintaining properly carbonated water in an electrically powered postmix fountain drink dispensing system when a supply of pressurized carbon dioxide is depleted. A carbon dioxide pressure sensor is connected between the carbon dioxide supply and the fountain drink dispensing system to sense the carbon dioxide supply pressure. A switch is connected to the carbon dioxide pressure sensor and coupled between the electrical power and the fountain drink dispensing system for disconnecting power to the fountain drink dispensing system when the carbon dioxide pressure is below a predetermined pressure. This is done so that water is not improperly carbonated with low pressure carbon dioxide and so that properly carbonated water and other drink components within the fountain drink system are maintained in the system by not dispensing fountain drinks until the pressurized carbon dioxide supply is replenished. Thus, the palatability of fountain drinks which are dispensed is stabilized without the need to clean out the entire system upon replenishing the carbon dioxide supply.

16 Claims, 7 Drawing Figures

PRESSURE SWITCH
22
SOLENOID VALVE
130
MIXING VALVE & REFRIGERATION UNIT
70
90
PRESSURE CONTROL AC INPUT CONTROL & OUTPUT SWITCH
52
LED 1
LED 2
26
36
20 PSI PRESSURE SWITCH CITY WATER
32
120 VAC
CARBONATOR UNIT
60

125
127
117
113
114
115
116
67
77
92
14

PALATABILITY STABILIZER

BACKGROUND OF THE INVENTION

The present invention relates to an improvement in postmix fountain drink equipment, and particularly to stabilizing the palatability of mixed fountain drinks dispensed by such equipment.

"Postmix fountain drink equipment" refers to equipment designed to mix a fountain drink syrup and carbonated water at a given ratio, typically five parts water to one part syrup, on location, to produce and dispense a fountain drink comparable to a canned or bottled carbonated drink. "Postmix" is to be differentiated from "premix", which refers to mixing of syrup and carbonated water prior to delivery of the product to the location for dispensing. Premix fountain drink equipment does not require the availability of water or carbon dioxide gas other than the use of carbon dioxide gas as a pressurizing agent for delivery of the premix fountain drink product to serving valves.

Postmix fountain drink equipment, on the other hand, requires the availability of water, fountain syrup, and carbon dioxide gas for the proper operation of the equipment. To serve a palatable product, it is necessary to ensure that the proper ratio of syrup and water is obtained. For this purpose the fountain syrup is supplied to a mixing valve and at the same time carbonated water is made available at the mixing valve from a carbonator. When the serving lever is depressed, the carbonated water and syrup are dispensed into a serving container.

The carbonator, which produces carbonated water, typically involves what is known as a "venturi effect" carbonator system. This system requires a constant supply of carbon dioxide gas under pressure within a specified pressure range; typically 80 to 100 pounds per square inch. This carbon dioxide gas is supplied to a carbonator tank and water is then injected into the carbonator tank charged with carbon dioxide gas. The water is injected at a pressure above that of the $CO_2$ gas, typically 150 to 175 pounds per square inch, to overcome the carbon dioxide charge. This interaction produces carbonated water and is referred to in the industry as "the venturi effect". The carbonated water is then supplied from the carbonator to the mixing valve and is dispensed therefrom mixed with the syrup when the valve is actuated. The correct mixture of syrup and carbonated water is set by a syrup metering adjustment on the machine valve head. Preferably the product is served at or below 40° F. which is usually accomplished by using a refrigerated "ice bank" method or an "ice blanket" over a cold plate.

There are several problems relating to the palatability of fountain drinks dispensed from presently used postmix fountain drink equipment. In particular, uncarbonated products or inadequately carbonated products may be dispensed when carbon dioxide is supplied at pressure below a certain pressure or when the carbon dioxide supply is completely depleted. Typically, the venturi effect carbonators do not operate properly to adequately carbonate the water when the carbon dioxide pressure falls below 70 psi. When this occurs, the carbonator tank is filled with improperly carbonated water. The uncarbonated water is then dispensed through the mixing valve along with a quantity of syrup and an inferior drink product is dispensed. Besides the problem of a dissatisfied customer, there are other undesirable effects.

First, the low $CO_2$ or "out of $CO_2$" situation may go unnoticed by the owner or operator of the dispensing machine such that numerous customers receive drinks which are not palatable, thereby reducing goodwill and even creating bad will toward the advertised manufacturer of the drink product.

The operator normally becomes aware of the out-of-carbon dioxide situation only after the fact. Because the supply lines of the postmix drink fountain equipment are filled with uncarbonated water and the syrup lines are filled with syrup, replacement of the carbon dioxide supply requires the operator to rebalance the system. This requires pulling out sufficient quantities of syrup and uncarbonated water through the mixing valve to allow carbonated water to reach the mixing valve. This wastes many ounces of valuable pure syrup. Usually a service call is required with the resultant expense and down time. Also, the energy required to cool the plain water which enters the carbonator tank and which is not used, as well as the new properly carbonated water, is wasteful and expensive.

Another problem associated with present postmix fountain drink machines arises when the water pressure supply to the carbonator pump drops below a particular minimum supply pressure value. Typically, carbonator pumps operate adequately in the range above 20 psi so that the water pressure can be increased by pump action up to the range of 150 to 175 psi. When the water pressure falls below a particular specified value, this can cause improperly carbonated fountain drinks to be dispensed because the water pressure from the pump is not high enough to permit proper venturi carbonation. Also, the carbonator tank can run completely dry such that the carbonator pump runs continuously and can easily cause the pump to burn up and require expensive service.

Once again, this situation necessitates balancing the system, including cleaning out the syrup supply lines to allow properly carbonated water to reach the mixing valve. Also, cooling the new components wastes energy.

Another problem associated with the palatability of the fountain drinks relates to maintaining an adequate supply of fountain drink syrup. When the syrup becomes depleted, the fountain drinks are dispensed as carbonated water only, or pure water only if the carbon dioxide is also depleted.

Previous references have addressed the problem of detecting when the syrup becomes depleted; but, have all failed to adequately address the problems associated with depleted supplies of carbon dioxide or water or the combination of all three components of a postmix fountain drink.

Kross et al., U.S. Pat. No. 3,940,019, relate to an automatic mixed drink dispensing apparatus which is directed primarily toward an apparatus for dispensing alcoholic mixed drinks. The Kross et al. patent shows a liquor sensing means which determines when liquor is depleted; but does not disclose or suggest means for overcoming the problem of lines filled with improper components which will be wasted and the described problems associated with inadequately pressurized carbon dioxide gas or inadequately pressurized water.

Keller et al., U.S. Pat. No. 3,112,844, relate to a measuring and dispensing apparatus for dispensing liquids from bottles using air pressure. Nothing is disclosed or suggested in the Keller et al. patent which would overcome problems associated with wasting syrup and energy in a postmix fountain drink machine when the carbon dioxide pressure falls below a predetermined level or when the other components of postmix fountain drinks become depleted.

Fuqua, U.S. Pat. No. 3,756,464, employs a pressure sensitive control valve in a premix fountain beverage system to determine when the liquid in the system becomes depleted. Nothing in Fuqua teaches or suggests means for stabilizing the palatability of fountain drinks dispensed from postmix fountain drink machines or the problems associated therewith as outlined above.

Other references to various drink mix dispensers disclose the idea of determining or measuring when the syrup becomes depleted. For example, Gust, U.S. Pat. No. 3,981,411, uses a float system. Dibell, U.S. Pat. No. 3,537,616, uses a system which weighs the liquid. Fridley, U.S. Pat. No. 3,366,276, uses a float and magnetic switch to determine the liquid level. Hanson, U.S. Pat. No. 2,880,910, uses electrodes to determine when they are no longer in contact with the liquid. None of these references relates to a postmix fountain drink system or to the problems related thereto with respect to pressurized carbon dioxide gas, or pressurized water supplied to the carbonator pump or in combination therewith, to the waste of liquid syrup caused by replenishing the depleted drink components.

Weston, U.S. Pat. No. 3,666,143, presents an improved beverage dispensing system capable of precisely dispensing predetermined volumes of beverage by varying the time the dispensing valve is opened. That system depends upon the variations in the pressure which forces liquid through the dispensing valve. Nothing in Weston teaches or discloses means or methods for overcoming the problems associated with postmix fountain drink machines.

SUMMARY OF THE INVENTION

Accordingly, the present invention relates to a palatability stabilizer for maintaining properly carbonated water in an electrically powered postmix fountain drink dispensing system when the supply of pressurized carbon dioxide is depleted. The invention includes a carbon dioxide pressure sensor connected between the carbon dioxide supply and the fountain drink dispensing system for sensing carbon dioxide supply pressure. Also, a switch connected to the carbon dioxide pressure sensor is coupled between the electrical power source and the fountain drink dispensing system for disconnecting power to the fountain drink dispensing system when the carbon dioxide pressure is sensed below a predetermined pressure value so that water is not improperly carbonated with low pressure carbon dioxide and so that properly carbonated water and other drink components within the fountain drink system are maintained in the system by not dispensing fountain drinks until the pressurized carbon dioxide supply is replenished. Thus, the palatability of the fountain drink which are dispensed is stabilized without cleaning out the entire system upon replenishing the carbon dioxide supply.

The invention also relates to a palatability stabilizer which also includes a water pressure sensor connected between the water supply and the fountain drink dispensing system for sensing water pressure. The switch described above is connected to the water pressure sensor for disconnecting power to the fountain drink dispensing system when the water pressure is below a predetermined pressure value so that properly carbonated water and other drink components within the fountain drink system are maintained in the system. Thus, the system is inoperable when either the carbon dioxide pressure is too low or the water pressure is too low, and the components can be replaced without clearing out the entire system and wasting the components in it.

In combination with the above-described palatability stabilizer, a flavor syrup level sensor is connected between the syrup supply and the system for sensing the syrup level. The switch is also connected to the syrup level sensing means for disconnecting power to the fountain drink dispensing system when the syrup quantity is below a predetermined syrup level so that properly carbonated water and other drink components within the fountain drink system are maintained in the system until the syrup supply is replenished. Thus, the palatability of the fountain drinks which are dispensed is stabilized without cleaning out the entire system upon replenishing any of the necessary components in a postmix fountain drink system.

DETAILED DESCRIPTION

The unique and unobvious invention may be understood through the description of the preferred embodiments and with reference to the figures.

Figure 1:
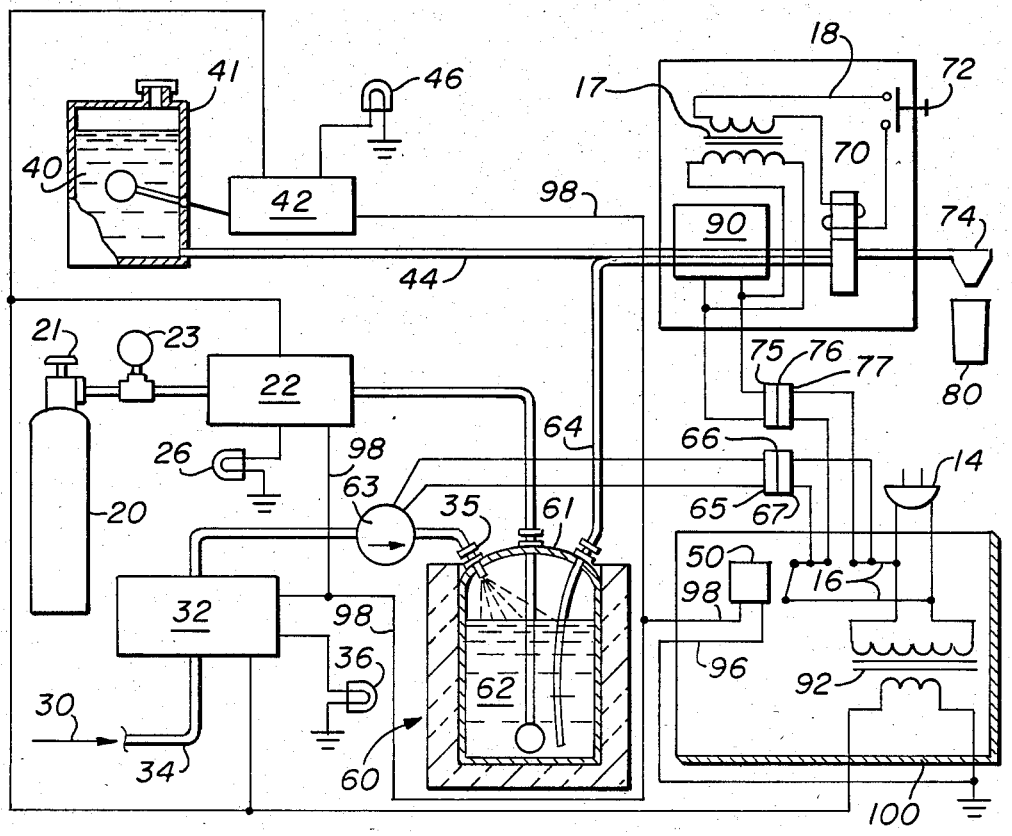
FIG. 1 is a schematic drawing of a postmix fountain drink machine of the present invention with a portion of the circuitry represented by a box into which alternative circuitry may be placed corresponding to circuitry shown in succeeding figures.

Referring now to FIG. 1 there is shown a schematic representation of a postmix fountain drink system generally designated as 10. The basic system comprises a carbon dioxide supply line 24 for connection with a supply of pressurized carbon dioxide 20 which may be any pressurized carbon dioxide bottle with a shut-off valve 21 and usable with any pressure regulator guage 23. Supply line 24 may be hollow tubular pipe, such as copper tubing or reinforced synthetic material. Supply line 24 is connected to the carbonator subsystem 60 for injection of carbon dioxide into carbonator tank 61.

The postmix drink machine further comprises water supply line 34 for coupling with a water supply 30. The present postmix systems are designed for interconnection to pressurized city water supplies 30 which under normal circumstances provide pressurized water at pressures of above 20 psi. Supply line 34 is connected to carbonator subsystem 60. Carbonator 60 is shown as a "venturi effect" carbonator system such that water is supplied to carbonator pump 63 which may be any known water pump 63. Water pump 63 may be any known water pump which increases the water pressure into the range 150–170 psi. In the preferred embodiment an electrically powered motor driven pump is used. The pressurized water from the pump 63 is injected into carbonator tank 61 at nozzle 35.

For proper carbonation to occur the carbon dioxide pressure provided to tank 61 through line 24 is intended to be regulated to approximately 70 psi. The water is injected through spray nozzle 35 at a pressure of 150–170 psi which overcomes the pressure of the $CO_2$ in the carbonator tank. The pressurized carbon dioxide is absorbed by the water to form carbonated water 62.

The third component needed for postmix fountain drinks is a supply of drink flavor 40. The drink flavor 40 may be any known commercially available drink flavor, including a liquid syrup 40 as shown in FIG. 1, which may be provided to the drink flavor supply line 44 at a pressure sufficient to cause the syrup to flow to the mixing valve 70. This pressure may be provided by the gravity feed head pressure or, alternatively, it may be provided by pressurization of supply tank 41 with pressurized gas by providing a portion of the pressurized carbon dioxide gas 20 into tank 41, or by any other method of providing drink flavor to the postmix fountain drink system. At the same time, carbonated water 62 flows through line 64 under pressure to mixing valve 70.

When mixing value 70 is activated through operator control switch 72, drink flavor 70 which flows through flavor supply line 44 is mixed with the carbonated water 62. The flavor 40 is mixed with the carbonated water 62 in a desired ratio which is typically on the order of one part drink flavor to five parts carbonated water. Mixing valve 70 may be any known mixing valve for combining carbonated water with a flavor and typically is of a type with adjustments so that the ratio of drink flavor to carbonated water may be adjusted precisely to a predetermined ratio. The mixed components are dispensed through dispensing head 74 into a serving container 80.

It will be understood by those skilled in the art that carbonated water 62 and flavor syrup 40 may be cooled prior to dispensing as by passing through a cooling unit 90 which may be an ice bath into which ice is packed around coiled lines 44 and 64. Alternatively, cooling unit 90 may be an electrically powered refrigeration unit in which a standard compressor, condenser, and refrigerant unit is used to form an ice bank through which lines 44 and 64 pass. The carbonated water and the drink flavor are cooled to approximately 40° F. which may be adjusted to optimize the retention of carbonation within the carbonated drink.

Power for the postmix fountain drink machine may be obtained from a standard 110–120 volt AC current supply which may be coupled at power source plug 14. It will be understood by those skilled in the art that power is supplied to the carbonator pump 63 of the carbonator unit 60. This has typically been achieved by coupling electrical connector 66 directly to a 120–110 VAC power source. Also the refrigeration unit 90, if it is electrically powered, may be coupled directly to the outside electrical current source at connector 76. Electrical power is also supplied to mixing valve 70. It will be further understood that where cooling unit 90 is merely an ice bath, electrical power is still provided to the mixing valve through electrical connector 76.

For safety reasons the power to the mixing valve and operator control switch 72 is a reduced voltage, usually less than 24 volts which may be accomplished by step-down transformer 17 placed anywhere in the power circuit prior to mixing valve 70. The high voltage current is insulated from and separated from the mixing valve. Thus, the operator control switch 72 is a low voltage switch so that the voltage in the wires to which an operator may be exposed is a safe low voltage. Thus, as shown in FIG. 1, step-down transformer 17 is connected through power source plug 14 to the 120 volt AC power supply and the step-down voltage is provided through circuit wires 18 to operator switch 72 and mixing valve 70.

The inventive palatability stabilizer provides means 22 to sense the pressure in the carbon dioxide supply line 24, as by pressure sensor 22. Carbon dioxide pressure sensing means 22 may be interposed and in carbon dioxide supply line 24 as shown in FIG. 1 or it may be attached to line 24 through any known means for connecting such as a T connector which permits pressure sensor 22 to communicate with the carbon dioxide gas passing through line 24. Pressure sensor 22 may be any known pressure sensing device which produces a detectable signal when the $CO_2$ pressure is below a predetermined pressure value. In the preferred embodiment a pressure actuated electrical switch is used.

A postmix fountain drink machine operates best at pressures above 70 psi such that the $CO_2$ pressure sensing device 22 produces a signal when the pressure is sensed below 70 psi. When the pressure is below 70 psi, the carbonation accomplished in the carbonator may be improper. Without sufficient carbon dioxide pressure, the water injected into the carbonator tank will not absorb sufficient amounts of carbon dioxide to produce a palatable fountain drink.

As shown in FIG. 1, the pressure sensor 22 is supplied with a electrical voltage which may either be the same as the input voltage 14 or which may be a different voltage produced by transformer 92 and supplied to sensor 22 through an electrical conductor circuit. When the pressure is sensed below the predetermined pressure, pressure sensing switch 22 will close to complete the circuit through conductor 98 which supplies current to switching means 50 which operates to break the circuit supplying power to carbonator pump 63 and mixing valve 70 and also cooling unit 90 if the cooling unit is of the type requiring electrical power.

Also to maintain properly carbonated water, it is necessary to provide water to pump 63 at any sufficient pressure to permit pump 63 to increase the pressure into the range of 150–170 psi. Moreover, if the pressure falls below approximately 20 psi, operation of pump 63 may cause damage to the system, as by pump cavitation or by "over-revving" problems. Water supply pressure sensing means 32 is interposed in supply line 34 in advance of carbonator pump 63. The pressure is sensed and if it falls below a predetermined value, such as 20 psi, a signal is introduced which is receivable by switching means 50. Upon receiving the signal, switching means 50 acts to shut off the power to pump 63 before improperly carbonated water is produced or any damage to the carbonator system or the carbonator pump occurs. In the embodiments shown in FIG. 1, water supply pressure sensing means 32 is supplied with a voltage through conductor 94 and if the pressure falls below the predetermined value the circuit is completed through conductor 98 to switching means 50, which may be an electromechanical relay 50, which opens the circuit to pump 63. Also the circuit to the mixing valve 70 and the refrigerating unit 90 is broken to completely inactivate the fountain drink machine before any improperly mixed fountain drink is dispensed.

Further shown in FIG. 1 is a means for sensing of the flavor level or the quantity of flavor supply available. When the flavor supply 40 is below a predetermined level, flavor sensor 42 produces a signal which is received by switching means 50 to deactivate or disconnect power to the pump 63, mixing valve 70, and refrigeration unit 90 if the machine has a refrigeration unit. As will be understood with reference to FIG. 1, power is supplied to flavor sensor 42 and when a level of flavor is sensed below a predetermined level, the circuit is completed through conductor 98 to activate relay 50 which breaks the circuit 16, thereby disconnecting power to the electrically operated elements of the postmix fountain drink machine.

The system can be operated with a single indicator light 26 which is provided with illuminating power whenever the system is automatically shut off by the palatability stabilizer. In the preferred embodiment separate indicator lights would be illuminated depending upon the cause of the automatic palatability stabilization shutdown. Thus, light 26 would be illuminated when carbon dioxide pressure sensing means 22 operates and light 36 when water pressure sensing means 32 operates. If the embodiment includes flavor level sensing means 42, then light 46 would be illuminated when it operates.

Figures 2, 7:
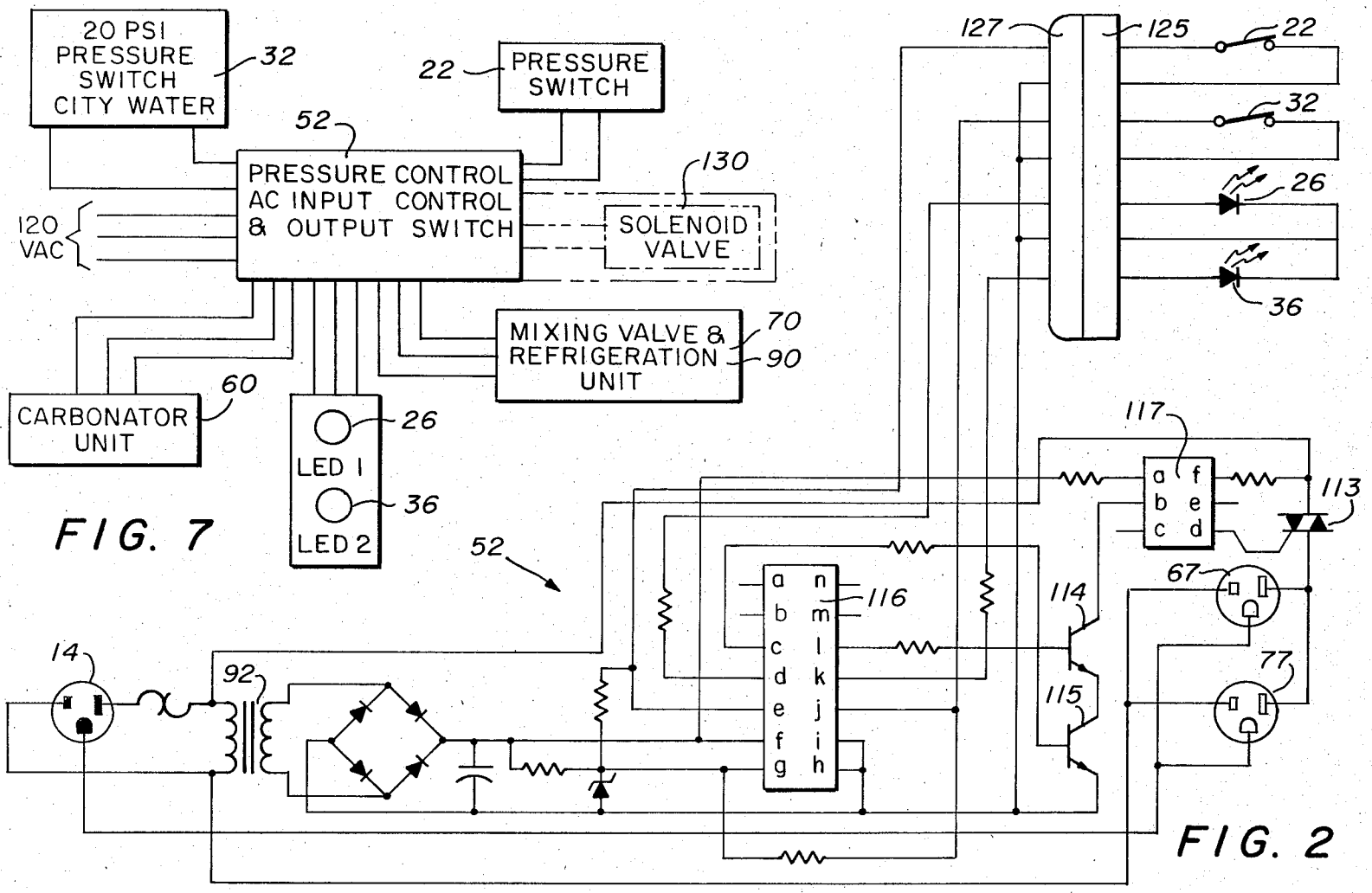
FIG. 2 is a schematic drawing of a kit for converting an existing postmix fountain drink machine for palatability stabilization according to the invention with the solid state electronic circuitry shown which may be inserted into the box of FIG. 1 to obtain one preferred embodiment of the inventive palatability stabilizer.
FIG. 7 is a schematic representation of an inventive palatability stabilizer system with the major elements of the system shown by open boxes with inter-connecting circuitry thereto and including among the elements an optional labor-saving solenoid valve for automatic component supply replenishing.
Figure 4:
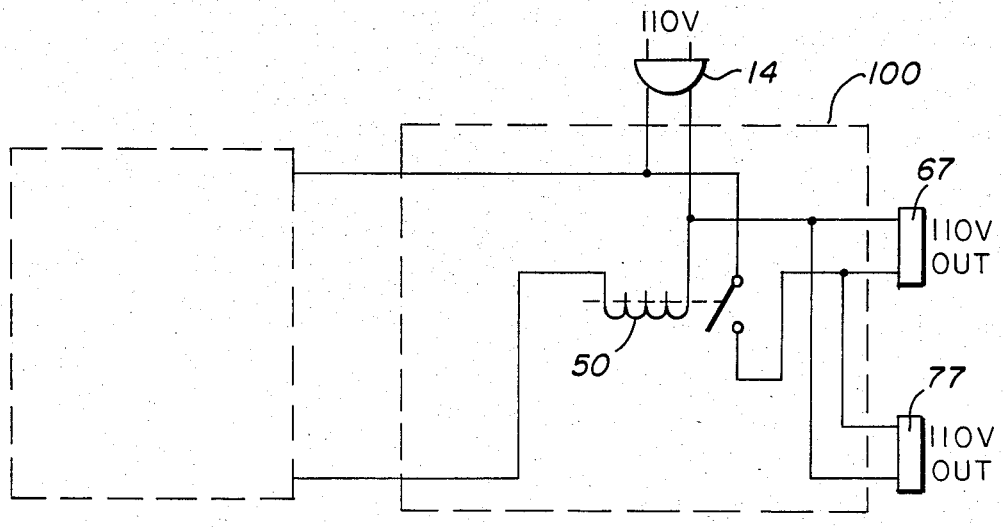
FIG. 4 is a schematic drawing of circuitry for use with existing postmix fountain drink machines which machines do not require the addition of a step-down transformer to reduce voltages where users might become exposed to electrical current.

FIG. 2, is a schematic drawing of solid state electrical circuitry for a preferred embodiment of a palatability stabilizer kit for modifying existing postmix fountain drink machines. It will be understood that the electronic circuitry of the kit shown in FIG. 2 could be used with a palatability stabilizer as shown in FIG. 1 by replacing the electromechanical relay 50 circuitry primarily contained in box 100 with the solid state electronic circuitry shown in FIG. 2. Also, the circuitry in box 100 of FIGS. 1, 3, 4, 5, or 6 may be replaced by the corresponding solid state circuitry of FIG. 2 or its equivalents. Thus, for example, the entire carbon dioxide actuated means of FIGS. 5 and 6 may comprise $CO_2$ sensor 22 and electromechanical relay 50; or, alternatively, $CO_2$ sensor 22 and electronic circuitry 52 of the kit shown in FIG. 2.

It will be understood with reference to FIG. 2, plug 14 is the main power plug for obtaining power for the postmix fountain drink machine and the palatability stabilizer. Receptacle 67 is for coupling to plug 65, as shown in FIG. 1, for providing power to the carbonator system 60 and the carbonator pump 63. Receptacle 77 is for providing power to the mixing valve 70 and also to the refrigeration cooling unit 90. A portion of the source power is transformed to a lower voltage in transformer 92. Carbon dioxide pressure switch 22 is for coupling to $CO_2$ supply line 24 and is attached to lead wires through selected prongs of multi-prong plug 125. Water pressure switch 32 is coupled to the water pressure line 34 and connected through lead wires to selected prongs of the multi-prong plug 125.

If the carbon dioxide pressure falls below a predetermined level, for example, 70 psi $\pm 2$ psi, switch 22 opens and breaks the ground at the integrated circuit dual driver 116 terminal e. This causes integrated circuit dual driver 116 terminal d to go high and energizes LED 26 to indicate to the operator that the machine has automatically shut off and that the $CO_2$ supply was the cause of the automatic shutdown. At the same time, integrated circuit dual driver 116 terminal c goes low and switches off transistor 115 which, in turn, switches off integrated circuit TRIAC driver 117 at terminal b thereof. This, in turn, switches off TRIAC 113 when integrated circuit TRIAC driver 117 terminal d goes low. TRIAC 113 is a commercially available THYRISTER which can be used as an electronic switch to open or close an alternating current power circuit. When the TRIAC 113 is shut off the power circuit to the postmix fountain drink machine coupled at receptacles 67 and 77 are also shut off. This, in turn, shuts off power to the carbonator pump 63, the mixing valve 70, and refrigeration unit 90.

If the water pressure falls below a predetermined pressure, such as 20 psi $\pm 2$ psi, switch 32 opens and breaks the ground at integrated circuit 116 terminal j. This causes 116 terminal k to go high and energizes LED 36 which indicates to the operator that the machine has automatically shut off and that the cause of the automatic shutdown was low water pressure. At the same time, integrated circuit 116 terminal 1 goes low and switches off transistor 114 which, in turn, switches off integrated circuit TRIAC driver 117. This, in turn, switches off TRIAC 113 so that power is disconnected from receptacles 67 and 77. This, in turn, automatically shuts off the postmix fountain drink machine which is coupled at 67 and 77. To facilitate use as a conversion kit, carbon dioxide pressure sensor means 22 and water presure sensor means 32 are connected through multi-prong plug 125 to multi-prong receptacle 127 which may easily be manually connected or disconnected. Likewise LED 26 and LED 36 are connected through multi-prong connector 125/127 so that the LED indicators may be placed in a convenient location for observation by the operator. It will be understood by those skilled in the art that if a flavor sensor 42 is desired, it may be connected through additional prongs on multi-prong connectors 125/127 and may be used to activate an integrated circuit triple driver by using additional terminals thereon, such that breaking the circuit at liquid level sensor 42 would break the circuit through a transistor to the TRIAC driver 117 which, in turn, would break the circuit to TRIAC 113.

Figure 3:
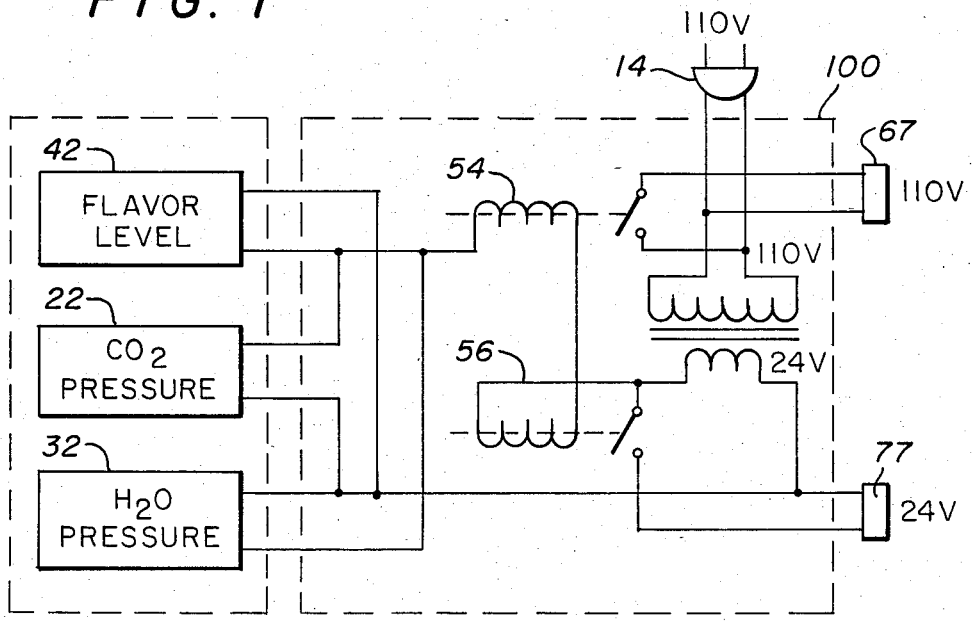
FIG. 3 is a schematic drawing of an alternative embodiment of the inventive palatability stabilizer incorporating three component sensors and circuitry and electromechanical relays which may be used to provide results approximating the results obtained with the solid state circuitry of FIG. 2.

In another alternative embodiment box 100 of FIG. 1 may be replaced with the circuitry of box 100 of FIG. 3 to provide a 24 volt output to receptacle 77. This may be useful, for example, where an ice bath is used and the mixing valve circuit is not already adapted for low voltage conversion. In such an embodiment, electromechanical relay 50 or the circuit 52, as shown in FIG. 2, could be replaced with a relay 54 for the high voltage current output circuit and relay 56 for the low voltage output circuit.

Figure 6:
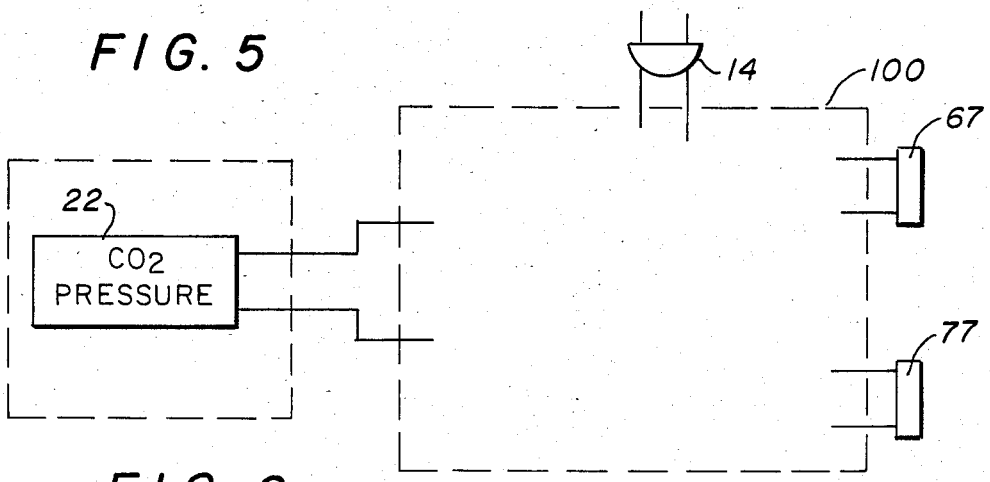
FIG. 6 is a further simplification of the invention which shows a sensor for carbon dioxide supply pressure only.

It will be understood with reference to FIG. 6 that the palatability stabilizer invention encompasses a palatability stabilizer comprising only carbon dioxide pressure sensing means in conjunction with any of the alternative circuitry in box 100 of FIG. 1, 2, 3, or 4. The embodiment depicted in FIG. 6 operates to disconnect the power to the fountain drink dispensing system when pressure is sensed below a predetermined carbon dioxide pressure value. Thus, where inadequate carbon dioxide pressure is the primary concern, which it may be where there is a dependable supply of water pressure, the palatability stabilizer may be simplified to accomplish stabilization of the carbonation of the fountain drink through a carbon dioxide pressure actuated means comprising a pressure sensing means 22 and switching means 50 as in FIG. 1 or 4, or 52 as in FIG. 2, or 54 and 56 as in FIG. 3.

Figure 5:
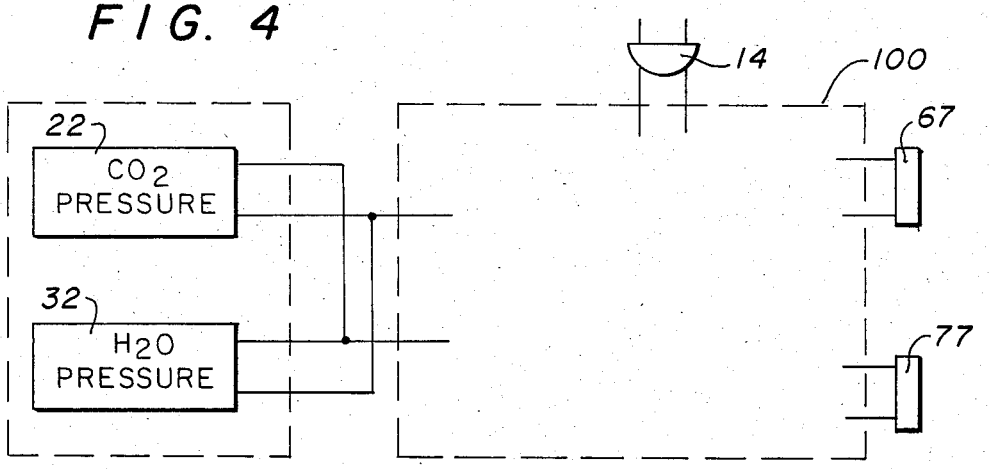
FIG. 5 is a schematic representation of a simplified version of the invention with sensors for carbon dioxide pressure and for water pressure only.

With reference to FIG. 5, it will also be understood that the palatability stabilizer system of this invention may be optimized by providing a carbon dioxide pressure actuated means in combination with a water pressure actuated means. Again, the circuitry of the water pressure actuated means may be as that shown in any of the alternative embodiments within box 100 of the various figures.

Of course, the inventive platability stabilizer also may be comprised of the combination of any of the various circuitry with a carbon dioxide pressure sensing means 22, a water pressure sensing means 32, and also a flavor level sensing means 42.

Shown in FIG. 7 is a schematic of an alternative palatability stabilizer where $CO_2$ pressure sensing means 22 is connected to the pressure control circuitry 52 as shown in detail in FIG. 2. Also, water pressure sensing means 32 is connected to circuit 52. The carbonator unit 60, which is comprised of carbonator pump 63 and the carbonator tank 61, as shown in FIG. 1, is electrically connected to control circuitry 52. Likewise, refrigeration 90 and mixing valve 70 and indicator lights 26 and 36, or LED 1 and LED 2, are connected to the control circuitry 52. FIG. 7 also shows an alternative embodiment in which prior to terminating power to the carbonator unit and the refrigeration and mixing valve unit, solenoid valve 130 may be activated to automatically move from a first carbon dioxide supply to a second carbon dioxide supply when pressure sensing means 22 indicates that the pressure has fallen below the predetermined operation pressure. If solenoid valve 130 moves the connection to a second low pressure carbon dioxide supply, then the system would be shut down as before While the invention has been described in connection with preferred embodiments, it is not intended to limit the scope of the invention to the particular forms set forth, but, on the contrary, it is intended to cover such alternatives, modifications, and equivalents as may be included within the spirit and scope of the invention as defined by the appended claims.

What I claim is:

1. A palatability stabilizer for use in a postmix fountain machine of the type requiring connection to a pressurized carbon dioxide supply, a water supply, and a drink flavor supply and of the type having a carbonator for connection to said carbon dioxide supply through a carbon dioxide supply line and for connection to said water supply through a water supply line, said carbonator for producing carbonated water, a mixing valve for connection to said flavor supply and connected to said carbonator for mixing a carbonated fountain drink prior to dispensing it, and an electrical power source connected to said carbonator and said mixing valve, said palatability stabilizer comprising:

(a) carbon dioxide pressure actuated means connected to said carbon dioxide supply line and to said power source for automatically disconnecting power to said carbonator and said mixing valve when the carbon dioxide pressure is below a predetermined carbon dioxide pressure, wherein said carbon dioxide pressure actuated means for disconnecting power further comprises:

(i) a carbon dioxide pressure-sensing electrical switch attached to said carbon dioxide supply line for sensing pressure therein between said carbon dioxide supply and said carbonator, and (ii) at least one relay electrically connected to said electrical power source through said carbon dioxide pressure switch for activation thereby, said relay having means therein for disconnecting power from said carbonator and said mixing valve when said relay is activated by said carbon dioxide pressure switch, thereby disabling the drink machine with properly proportioned drink components therein before the carbonated water in said carbonator is inadequately carbonated; and (b) water pressure actuated means connected to said water supply line and to said power source for automatically disconnecting power to said carbonator and said mixing valve when the water pressure is below a predetermined water pressure.

2. A post mix fountain drink palatability stabilizer as in claim 1 wherein said water pressure actuated means for disconnecting power comprises:

(a) a pressure-sensing electrical switch attached to said water supply line for sensing pressure therein between said water supply and said carbonator; and (b) said at least one relay electrically connected to said electrical power source through said water pressure switch for activation thereby, said relay having means therein for disconnecting power from said carbonator and said mixing valve when said relay is activated by said water pressure switch, thereby disconnecting the drink machine before the carbonated water in said carbonator is improperly carbonated.

3. A palatability stabilizer as in claim 2 wherein said at least one relay comprises a solid state electronic circuitry.

4. A palatability stabilizer as in claim 3 wherein said power source connected to said carbonator is a first electrical current at a first electrical voltage and said power source connected to said mixing valve is a second electrical current at a second electrical voltage and wherein said first and second voltages would be disconnected by either said carbon dioxide pressure actuated means when the carbon dioxide pressure is below said predetermined carbon dioxide pressure or said water pressure actuated means when said water pressure is below said predetermined water pressure.

5. A palatability stabilizer as in claim 4 further comprising:

(a) at least one indicator light connected to said palatability stabilizer; and (b) means for providing power to said at least one indicator light at said second voltage value when power is disconnected to the carbonator and said mixing valve.

6. A palatability stabilizer as in claim 5 wherein said at least one indicator light comprises:

(a) a first indicator light connected to said carbon dioxide pressure-sensing switch and only activated thereby when said carbon dioxide pressure is below said predetermined carbon dioxide pressure; and (b) a second indicator light connected to said water pressure-sensing switch and only activated thereby when said water pressure is below said predetermined water pressure.

7. A palatability stabilizer as in claim 6 further comprising a drink flavor supply level detection means connected to said drink flavor supply and to said power source for automatically disconnecting power to said carbonator and mixing valve when the drink flavor supply is below a predetermined drink flavor quantity.

8. A palatability stabilizer as in claim 7 further comprising a third indicator light connected to said drink flavor level sensing switch and activated thereby when said drink flavor level is below said predetermined syrup quantity.

9. A post mix fountain drink apparatus comprising:

(a) a water supply;

(b) a pressurized carbon dioxide supply;

(c) a syrup supply;

(d) a water supply line connected to said water supply;

(e) a carbon dioxide supply line connected to said carbon dioxide supply;

(f) a syrup supply line connected to said syrup supply;

(g) a water pump connected to said water supply line;

(h) a carbonator tank connected to said water pump and said carbon dioxide supply line for receiving pressurized carbon dioxide from said carbon dioxide supply and pressurized water from said water pump and for forming carbonated water;

(i) a mixing valve connected to said carbonator and said syrup supply line for receiving said carbonated water from said carbonator and said syrup from said syrup supply line and for mixing said carbonated water and syrup in a predetermined ratio prior to dispensing the mixture as a fountain drink;

(j) a dispensing means connected to said mixing valve for directing said fountain drink mixture out of said fountain drink apparatus;

(k) an electrical power source connected to said water pump and to said mixing valve;

(l) a pressure sensitive switch in said carbon dioxide supply line which is closed to permit electrical current to pass through said switch when the carbon dioxide pressure in said carbon dioxide supply line is below a predetermined pressure and which is opened to prevent electrical current from passing through it when the carbon dioxide pressure is above said predetermined pressure; and (m) an electrical relay switch interposed between said electrical power source and said water pump, and between said electrical power source and said mixing valve, which relay is normally closed to permit current to flow to said water pump and to said mixing valve when not activated and which is electrically connected to said carbon dioxide pressure switch for activation of said relay to an open position when current flows through said carbon dioxide pressure switch thereby disconnecting power to said water pump and said mixing valve so that when the carbon dioxide supply is below a predetermined pressure, the apparatus is made inoperative before any improperly carbonated water is produced in said carbonator tank, before properly carbonated water in said carbonator tank is depleted, and before improperly carbonated fountain drinks are dispensed.

10. An apparatus as in claim 9 further comprising:

(a) a water pressure sensitive switch in said water supply line, which is normally closed to permit electrical current from passing through it when the water pressure is below a predetermined pressure and which is opened to prevent electrical current to pass through it when the water pressure is above said predetermined pressure; and (b) an electrical relay switch interposed between said electrical power source, said water pump, and said mixing valve, which relay is closed to permit current to flow to said water pump and to said mixing valve when not activated and which is electrically connected to said water pressure switch for activation of said relay to an open position when current flows through said water pressure pressure switch, thereby disconnecting power to said water pump and said mixing value to make the apparatus inoperative, if the water supply pressure is too low for proper carbonation, before any improperly carbonated water is produced in said carbonator tank, before properly carbonated water in said carbonator tank is depleted and before improperly carbonated fountain drinks are dispensed.

11. A palatability stabilizer kit for modifying an existing post mix fountain drink machine of the type having an electrical power source plug, a carbon dioxide supply line, a water supply line, a carbonator including a water pump electrically connected to said power source plug for pressurizing water from said supply line and a carbonator tank for receiving pressurized water and carbon dioxide and for producing carbonated water therefrom, said palatability stabilizer kit comprising:

(a) carbon dioxide pressure-sensing means for coupling to said fountain drink machine for producing a first signal when the carbon dioxide pressure in said carbon dioxide supply line falls below a first predetermined pressure;

(b) water pressure-sensing means for coupling to said fountain drink machine for producing a second signal when the water pressure in said water supply line falls below a second predetermined pressure;

(c) means for obtaining input power for said carbon dioxide sensing means and said water sensing means;

(d) an electrical receptacle for coupling to said power source plug of said postmix fountain drink machine;

(e) circuit means for normally providing at least a portion of said input power to said electrical receptacle;

(f) means, in said circuit means, for disconnecting power to said receptacle upon receiving either said first or second signal so that power to said power source plug is shut off when either carbon dioxide pressure is below said first predetermined pressure or water pressure is below said second predetermined pressure;

(g) means for transmitting said first signal from said carbon dioxide sensing means to said means for disconnecting power; and (h) means for transmitting said second signal from said water sensing means to said means for disconnecting power.

12. A palatability stabilizer kit as in claim 11 for modifying an existing postmix fountain drink machine of the type further having a mixing valve and a second power source plug, said palatability stabilizer kit further comprising:

(a) a second receptacle for coupling to said second power source plug;

(b) circuit means for providing a portion of said input power to said second receptacle; and (c) wherein said means for disconnecting power to said first receptacle also disconnects power to said second receptacle upon receiving either said first or second signal.

13. A palatability stabilizer kit as in claim 12 further comprising:

(a) at least one indicator light connected to said palatability stabilizer; and (b) means for providing power to said indicator light when power is disconnected by said means for disconnecting power to said carbonator and said mixing valve.

14. A palatability stabilizer kit as in claim 13 wherein said at least one indicator light comprises:

(a) a first indicator light connected to said carbon dioxide pressure-sensing switch and activated thereby when said carbon dioxide pressure is below said predetermined carbon dioxide pressure; and (b) a second indicator light connected to said water pressure-sensing switch and activated thereby when said water pressure is below said predetermined water pressure.

15. A palatability stabilizer kit as in claim 14 for modifying an existing post mix fountain drink machine of the type further having a liquid syrup supply line, said palatability stabilizer kit further comprising:

(a) liquid syrup supply sensing means for coupling to said fountain drink machine and for producing a third signal when said syrup supply is below a predetermined level;

(b) means for transmiting said third signal to said means for disconnecting power; and (c) wherein said means for disconnecting power is adapted for receiving said third signal and for disconnecting power from said source plug upon receiving said first, second, or third signal.

16. A palatability stabilizer kit as in claim 15 further comprising a third indicator light connected to said syrup level sensing switch and activated thereby when said syrup level is below said predetermined syrup level.

* * * * *